United States Patent [19]

Prewarski

[11] 4,093,220

[45] June 6, 1978

[54] TENNIS RACKET STRING NETWORK

[76] Inventor: Mike Prewarski, 3432 Lansdowne Dr., Lexington, Ky. 40502

[21] Appl. No.: 736,585

[22] Filed: Oct. 28, 1976

[51] Int. Cl.[2] ..... A63B 51/00

[52] U.S. Cl. ..... 273/73 D

[58] Field of Search ..... 273/73 R, 73 D

[56] References Cited

U.S. PATENT DOCUMENTS

| | | | |
|---|---|---|---|
| 971,773 | 10/1910 | Mueller | 273/73 D |
| 1,132,214 | 3/1915 | Ries et al. | 273/73 D |
| 1,733,960 | 10/1929 | Godfrey | 273/73 D |
| 3,834,699 | 9/1974 | Pass | 273/73 D |
| 4,013,289 | 3/1977 | Kaminstein | 273/73 D |

FOREIGN PATENT DOCUMENTS

| | | | |
|---|---|---|---|
| 781,609 | 2/1935 | France | 273/73 D |
| 901,279 | 10/1944 | France | 273/73 D |
| 224,964 | 11/1924 | United Kingdom | 273/73 D |
| 269,092 | 4/1927 | United Kingdom | 273/73 D |

OTHER PUBLICATIONS

"Tennis," Jul. 1976; p. 21.

*Primary Examiner*—Richard J. Apley

[57] ABSTRACT

In rackets for tennis and like games, a string network consisting of longitudinal and cross strings interwoven alternately to construct a regular 'basket weave' pattern at the center of the striking face and woven in a special manner at the sides and at one or both ends of the string network. At the sides the cross strings are woven over and under two or three longitudinal strings with consecutive cross strings alternating the over and under pattern. At the ends, above and below the said center striking area, two or three cross strings are woven identically and farther outward towards the ends of the string network, the over and under pattern is alternated with one, two or three consecutive cross strings.

6 Claims, 5 Drawing Figures

TENNIS RACKET STRING NETWORK

BACKGROUND OF THE INVENTION

This invention relates to tennis rackets, and more particularly the manner in which the strings are strung in an ordinary tennis racket.

Nearly all tennis rackets now sold and used are strung in a regular 'basket weave' pattern. The longitudinal direction is usually strung first then the cross strings are woven alternately under and over the longitudinal strings. This stringing method entraps each string so that there is very little movement when side forces are imparted to the strings, such as when the ball is struck to impart a spin to the ball. The restoring forces created by the weave pattern try to maintain the regular spacing between the strings.

This common stringing method is fine if the ball is struck on the center of the striking face or slightly below center which is usually the percussion center, frequently referred to as the sweet spot of most tennis rackets. Away from the center up or down or on either side, the strings are shorter between supports, consequently, the resilience decreases, effective spring constant increase. The resilience further decreases because the ball is struck closer to the frame which anchors the strings. Consequently, when the ball is hit off center, the net effect of the decreased resilience is to: increase the shock, increase the turning or twisting forces as felt in the hand of the player. Even if the player can hold the racket firmly enough to resist the twisting forces, the ball will still move off the racket in unexpected and unwanted directions.

When the ball contacts the string, it will flatten. Therefore, the rate of change in resilience will affect the direction the ball leaves the striking face. For example, imagine the ball rising when it is struck. If the ball is struck near the top side of the string face with a flat stroke, the stiffer strings at the top side will tend to direct the ball downward into the net. If the same ball is struck with an intended top spin where the tendency would be to strike the ball near the bottom side of the hitting face, the stiffer strings at the bottom side will lift the ball higher than intended and direct the ball beyond the court.

Some tennis racket designers have made frame structural changes to make the string network a more uniform striking surface. The 'Prince' tennis racket made the striking surface larger, proportionally wider and varied the string network spacing, closer near the center. The Wilson metal racket also made the striking head rounder and varied the spacing. C. L. Godfrey in his U.S. Pat. No. 1,733,960, Oct. 29, 1929, added additional string at the center. A new tennis racket market by Sabine Tennis Project under the trade name Sweet-Spot varied the spacing more than previously designed tennis rackets by eliminating both vertical and cross strings near the frame.

SUMMARY OF THE INVENTION

The object of this invention is to provide improved stringing network usable in ordinary tennis rackets without any modification to the frame that gives a more uniform striking surface characteristic at the center, at the percussion center and away from center than is possible with a common stringing arrangement. The improved stringing network(s) will:

1. Improve ball control because:

(a) twisting movements are reduced.
(b) more even reaction forces on surface of ball which is flattened on the string network.
(c) the stringing network is less sensitive to the spin of the ball imparted by opponent.

2. Allow a player to hit the ball harder for the same reasons given above.
3. Allow a player tactics not now easily possible with an ordinary stringing network. For example, blocking a hard serve with a lot of spin on the ball.
4. Reduce the shock and strain a player usually feels due to off-center hits.

DETAILED DESCRIPTION OF THE INVENTION

Figure 1:
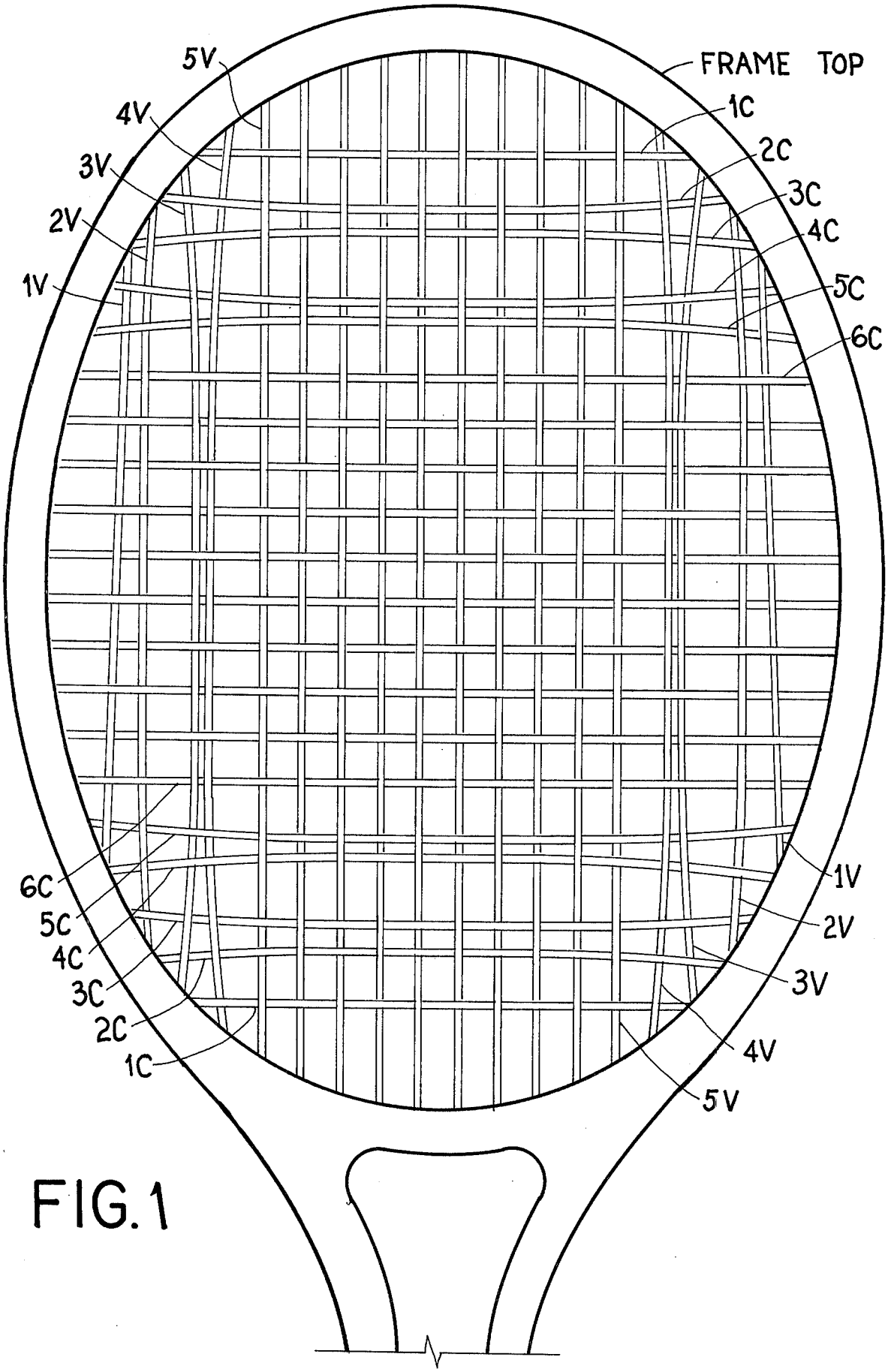
FIG. 1 is a front view of a racket head strung with a regular weave pattern at the center and 2, 2 pattern at the sides and 1, 2, 2 pattern at both ends.

With reference to FIG. 1, the drawing represents a typical tennis racket frame with provisions for stringing network having eighteen strings in the longitudinal direction, V direction, and twenty cross strings, C direction. FIG. 1 also illustrates the improved stringing network. At the center of the striking face starting with 6C string at each end and with 5V at each side the string network is the regular 'basket weave' pattern. Around center on all four sides of the regular 'basket weave' pattern the network is modified.

At the sides starting with longitudinal string 4V, the cross strings are alternately strung over and under two longitudinal strings. The result of this method is to pull longitudinal strings, 1V and 2V closer together, also longitudinal strings 3V and 4V closer together by the forces of the cross strings. Longitudinal strings 3V and 4V will be closer together than 1V and 2V as shown in the diagram.

At the top and bottom the stringing network is again altered to increase and decrease the string spaces in the longitudinal direction. Starting at the top, the first cross string 1C is strung in a regular manner. The second cross string 2C is strung opposite the first strings, that is, the second cross string goes under the longitudinal string where the first went over. The third cross string 3C is strung identical to 2C. Fourth 4C and fifth 5C cross strings are strung identically and opposite to 2C and 3C strings. This stringing schedule will cause strings 2C and 3C pulled closer together, also strings 4C and 5C are pulled closer together.

The described stringing network provides a suspension for the center striking face strung in a regular 'basket weave' pattern. It also increases the relative resilience of the shorter outer strings with respect to the inner strings. The resultant network gives a more uniform resilience over nearly the complete usable striking area. This particular network is identified as 2, 2 at the sides and 1, 2, 2 at the ends.

Figure 2:
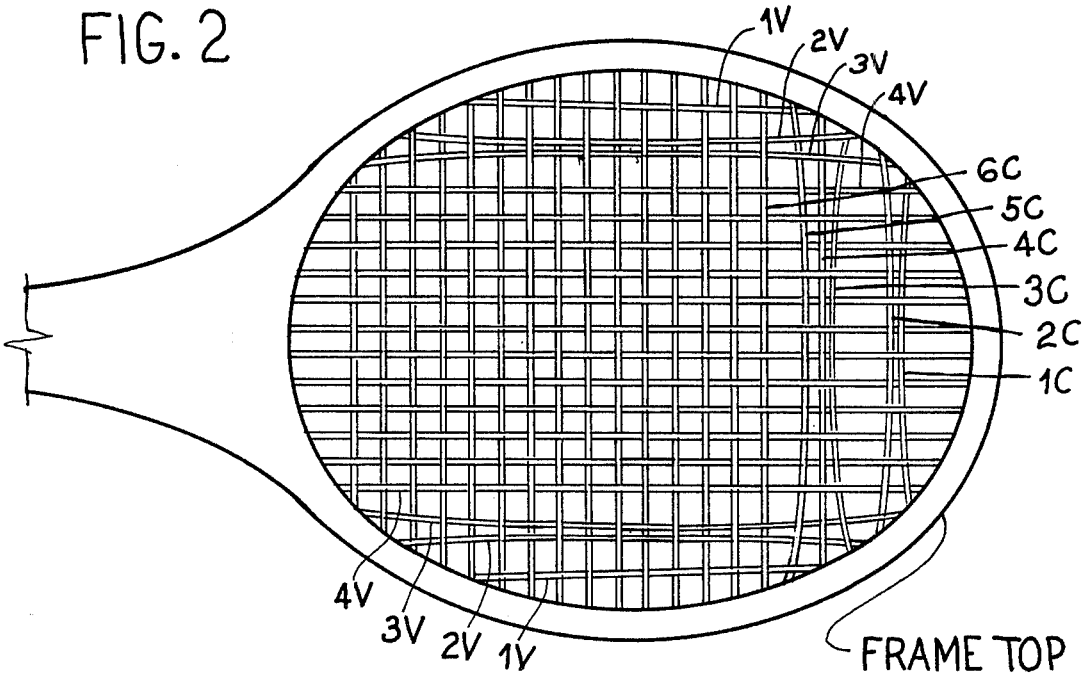
FIG. 2 is a front view of a racket head strung with a regular weave pattern at the center and 1, 2 pattern at the sides and 2, 3 pattern at the top.
Figure 4:
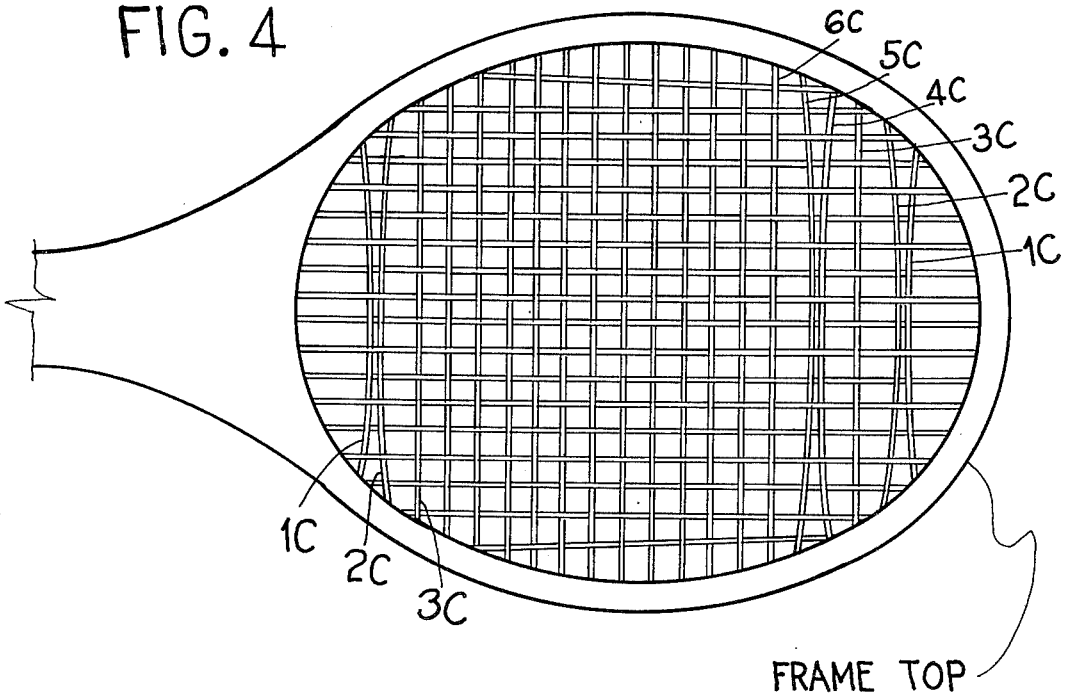
FIG. 4 is a front view of a racket head strung with a regular weave pattern at the center and both sides, and with a 2 pattern at the bottom and 2, 1, 2 pattern at the top.
Figure 5:
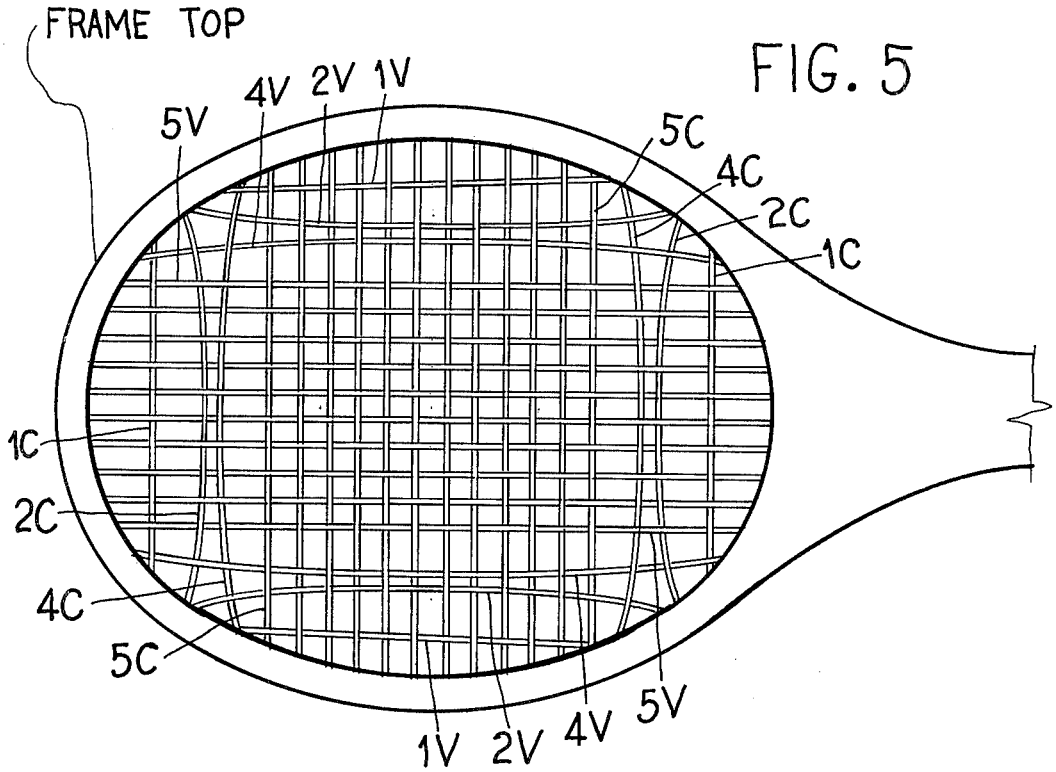
FIG. 5 is a front view of a racket head strung with a regular weave pattern at the center with a 1,2 pattern at each side and both ends, and with the third cross string, 3C, at both ends and the third longitudinal strings, 3V, at each side omitted.

It is obvious that a number of string networks can be derived using minor variations of the string network just described. For example, the weave pattern at the sides can be extended towards the center to make a 1, 2, 2 or a 2, 2, 2 pattern or retracted to a 1, 2 or 2 pattern. FIG. 2 shows a racket head strung with a 1, 2 pattern at the sides. Similarly, in the longitudinal direction, the pattern can be changed from 1, 2, 2 pattern at the ends to 2, 1, 2 pattern, or extended, or retracted to include more or less strings in the altered pattern. FIG. 4 shows a racket head strung with a 2, 1, 2 pattern at the top and a 2 pattern at the bottom. Elimination of one of the peripheral strings is also possible. On wood rackets, the second string, 2C, from the bottom or closest to the throat can be easily eliminated. At the sides and top, elimination of a string is more difficult except on many composite and metal rackets, which employ a continuous groove to protect the strings or don't extend the strings to the outside of the frame. FIG. 5 is a front view of a racket head strung with a regular weave pattern at the center and with a 1, 2 pattern at each side and both ends, and with the third cross strings, 3C, at both ends and the third longitudinal strings, 3V, at each side omitted.

Figure 3:
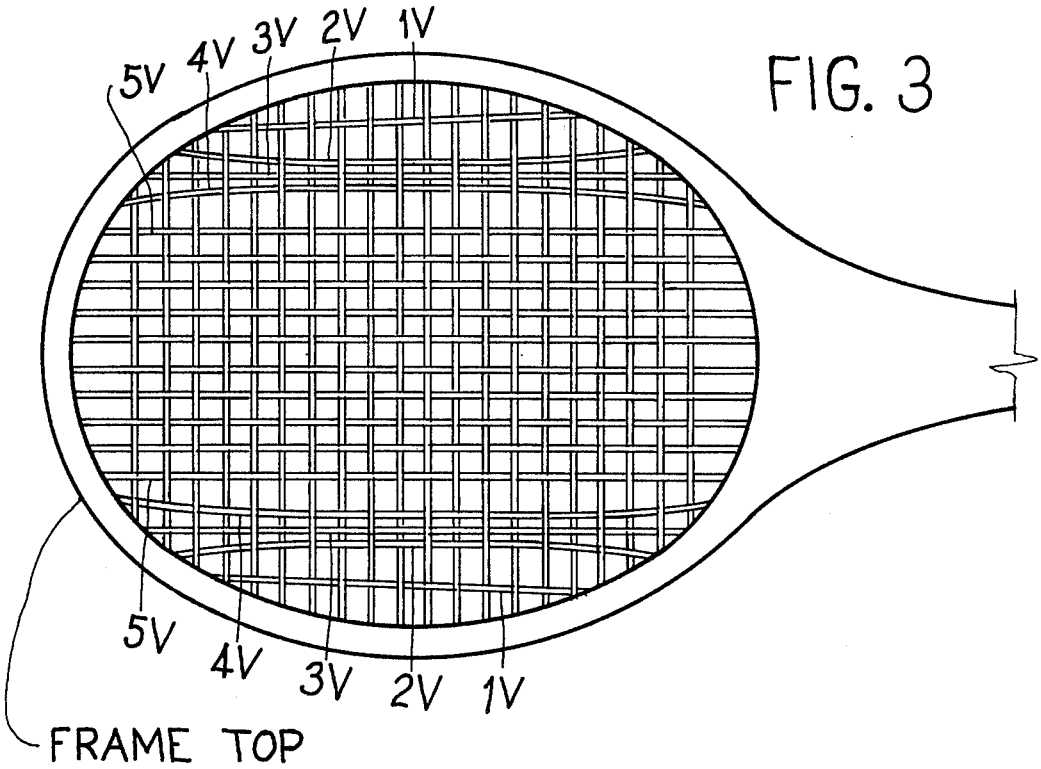
FIG. 3 is a front view of a racket head strung with a regular weave pattern at the center and at both ends, and with a 1,3 pattern at both sides.

Another variation is to surround the regular 'basket weave' pattern at the center with three string arrangement. At the sides the 2, 2 pattern can be changed to 1, 3. FIG. 3 shows a racket head with the sides altered to a 1, 3 pattern. At top and bottom the 1, 2, 2 pattern can be changed to 2, 3 pattern. FIG. 2 shows a racket head strung to a 2, 3 pattern at the top and a regular 'basket weave' pattern at the center and bottom.

I claim:

1. A racket comprising:

a frame defining a central opening;

a handle extending outwardly from said frame;

first string means forming a plurality of longitudinal strings extending in the direction of said handle, spaced over the central opening and attached to said frame under tension;

second string means forming a plurality of cross strings extending at right angles to the first string means, spaced over the central opening and attached to said frame under tension;

a plurality of centrally located strings of the first and second string means being interwoven in the conventional basket-weave pattern and forming an imaginary center striking area bounded by longitudinal side strings and cross end strings;

the cross strings spaced from the longitudinal side strings being interwoven over and under at least two longitudinal strings with consecutive cross strings alternating the over and under pattern; and a plurality of cross strings spaced from at least one end of the cross end strings being interwoven with a plurality of longitudinal strings in an identical predetermined pattern.

2. A racket as recited in claim 1 wherein a plurality of centrally located strings of the first and second string means being interwoven in the conventional basket-weave pattern and forming an imaginary center striking area bounded by longitudinal side strings and frame ends.

3. A racket as recited in claim 1 wherein a plurality of centrally located strings of the first and second string means being interwoven in the conventional basket-weave pattern and forming an imaginary center striking area bounded by the sides of said frame and said cross end strings.

4. A racket comprising;

a frame defining a central opening;

a handle extending outwardly from said frame;

first string means forming a plurality of longitudinal strings spaced over said opening, extending in the direction of said handle and attached to said frame under tension;

second string means forming a plurality of cross strings spaced over said opening, extending at right angles to the first string means and attached to said frame under tension;

ten centrally located first string means being interwoven with at least ten centrally located second string means in the conventional basket-weave pattern to form an imaginary center striking area bounded by longitudinal side strings and cross end strings;

the remaining strings comprising at least three longitudinal strings and at least three cross strings bounding said striking area;

cross strings spaced from the longitudinal side strings being interwoven over two and under at least one longitudinal string with consecutive cross strings alternating the over and under pattern;

at least a first pair of cross strings spaced from the cross end string above the imaginary striking area being interwoven with the longitudinal strings in an identical pattern, a first final cross string located farther towards the top end of the frame than said first pair of cross strings being interwoven with the longitudinal strings in a predetermined pattern relative to said first pair of cross strings; and at least a second pair of cross strings spaced from the cross end string below the imaginary stiking area being interwoven with the longitudinal strings in an identical pattern and alternate to said first pair of cross strings, a second final cross string located farther towards the bottom end of the frame than the said second pair of cross strings being interwoven with the longitudinal strings in a predetermined pattern relative to said second pair of cross strings.

5. A racket as recited in claim 4 wherein ten centrally located first string means are interwoven with ten centrally located second string means in the conventional basket-weave pattern to form an imaginary center striking area bounded by longitudinal side strings and cross end strings;

the remaining strings comprising four longitudinal strings and five cross strings bounding the said striking area;

cross strings spaced from the longitudinal side strings being interwoven over two and under two longitudinal strings with the consecutive cross strings alternating the over and under pattern;

a third pair of cross strings being located intermediate of said first pair of cross strings and first final cross string and being interwoven with the longitudinal strings in an identical pattern and alternate to said first pair of cross strings and identical to said second pair of cross strings, the predetermined pattern of said first final cross string being alternate to said third pair of cross strings and similar to said first pair of cross strings;

a fourth pair of cross strings being located intermediate of said second pair of cross strings and second final cross string and being interwoven with the longitudinal in an identical pattern and alternate to said second pair of cross strings and identical to said first pair of cross strings, the predetermined pattern of said second final cross string being alternate to said fourth pair of cross strings and similar to said second pair of cross strings.

6. A racket as recited in claim 4 wherein the predetermined pattern of said first and second final cross strings are respectively alternate to said first and second pair of cross strings.

* * * * *